United States Patent [19]

Krane

[11] 4,091,929

[45] May 30, 1978

[54] ICE CREAM CONTAINER

[76] Inventor: Bruce E. Krane, 1350 B Bluff Ave., Columbus, Ohio 43212

[21] Appl. No.: 745,379

[22] Filed: Nov. 26, 1976

[51] Int. Cl.[2] ..... B65D 5/54; B65D 3/28

[52] U.S. Cl. ..... 206/602

[58] Field of Search ..... 229/51 DB, 3.1; 206/602

[56] References Cited

U.S. PATENT DOCUMENTS

| | | | |
|---|---|---|---|
| 687,643 | 11/1901 | Megloughlin et al. | 229/51 DB UX |
| 1,570,682 | 1/1926 | Kling | 229/51 DB UX |
| 1,815,800 | 7/1931 | Respess | 229/51 DB UX |
| 2,717,619 | 9/1955 | Whitman | 229/51 DB UX |
| 2,969,902 | 1/1961 | Cage | 229/4.5 |
| 3,137,437 | 6/1964 | Svensson | 229/51 DB |
| 3,147,902 | 9/1964 | Miller | 229/3.1 X |
| 3,224,633 | 12/1965 | Allen | 229/51 DB X |
| 3,343,746 | 9/1967 | Shiffman | 229/51 DB |
| 3,620,439 | 11/1971 | Morris | 229/51 DB X |
| 3,910,482 | 10/1975 | Bamburg et al. | 229/51 DB X |
| 3,967,773 | 7/1976 | Kauffman | 229/51 DB |

*Primary Examiner*—Davis T. Moorhead

*Attorney, Agent, or Firm*—Olson, Trexler, Wolters, Bushnell & Fosse, Ltd.

[57] ABSTRACT

A cylindrical container is provided at axially spaced locations with peripheral rip-strips for shortening the height of the container as the contents are used up. The original lid fits over the container following shortening thereof. Sealing means is applied over the juncture of each rip-strip with the remainder of the carton to prevent leakage.

2 Claims, 5 Drawing Figures

FIG.1
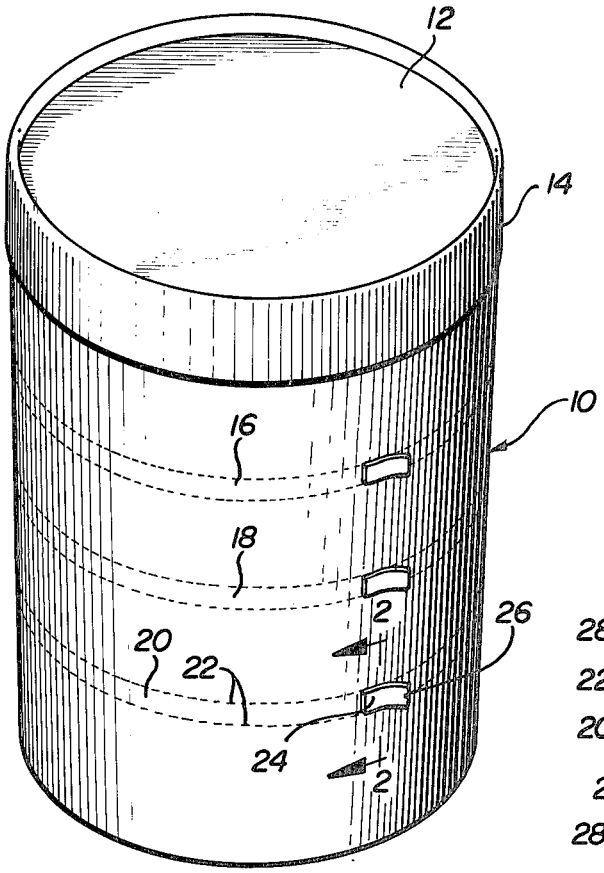
FIG. 2
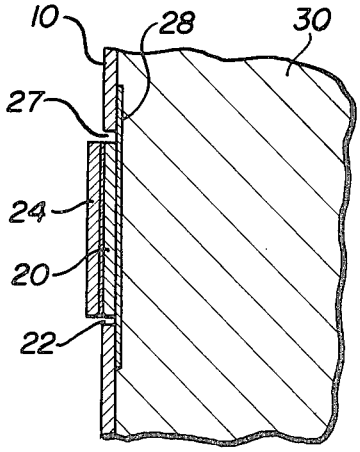
FIG.3
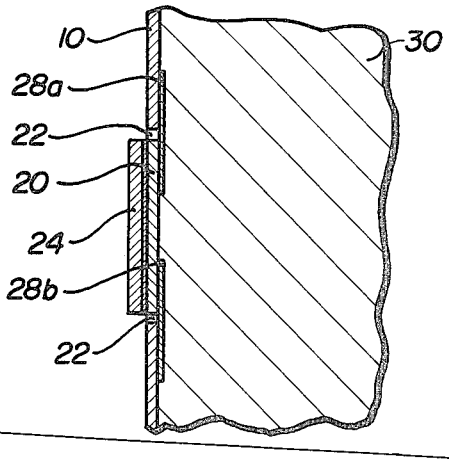
FIG.4
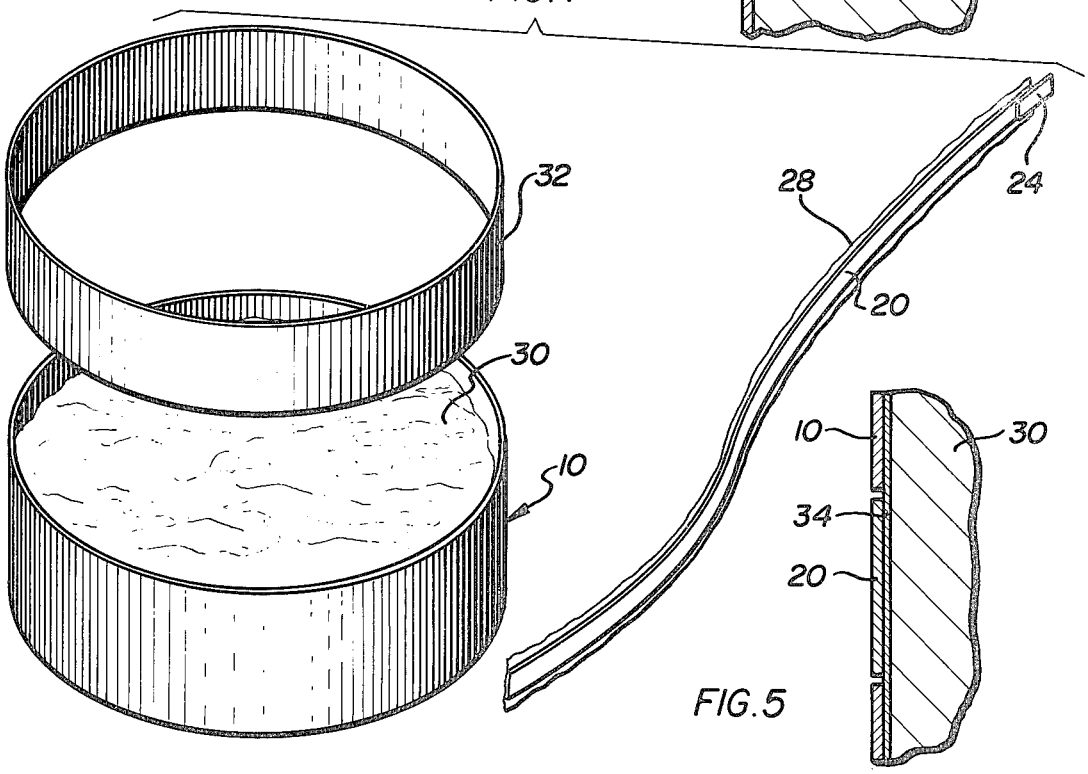
FIG.5

ICE CREAM CONTAINER

BACKGROUND AND OBJECTS OF THE INVENTION

Ice cream is often supplied in cylindrical containers, particularly in larger sizes, such as gallons and larger. It may also be supplied in cylindrical containers of smaller measure than a gallon. In conventional ice cream containers the container takes up just as much room in the freezer when it is nearly empty as it does when it is full.

Accordingly, as an object of the present invention to provide one or more rip-strips along the axial length of the container for shortening the container one or more times as the ice cream is used up therefrom.

Yet another object of the present invention is to provide an ice cream container with one or more rip-strips along the axial length thereof with means sealing the rip-strips to balance of the container to prevent leakage when fluid ice cream initially is deposited therein, or upon softening of the ice cream during shipment between the factory and the ultimate consumer.

THE DRAWINGS

The invention will best be understood with reference to the drawing when taken in connection with the accompanying descriptive portion of the specification following hereinafter. In the drawings:

FIG. 1 comprises a perspective view of an ice cream container constructed in accordance with my present invention;

FIG. 2 is a sectional view as taken along the line 2—2 in FIG. 1;

FIG. 3 is a sectional view similar to FIG. 2 showing a modification of the invention;

FIG. 4 is a partially exploded perspective view showing the separated container and rip-strip and FIG. 5 is a view similar to FIG. 2 showing a further modification.

DETAILED DESCRIPTION OF THE ILLUSTRATIVE EMBODIMENT

Referring first to FIG. 1, there will be seen a container for ice cream or the like generally identified by the numeral 10. The container is of right cylindrical configuration, and is provided with a lid 12 having a depending peripheral flange 14 overlying the top portion of the container.

The container is illustrated as being a large container, such as one containing one or more gallons, but could equally well be a smaller container. The inventive feature of the present invention resides in the provision of rip-strips or tear strips 16, 18 and 20 at axially spaced locations on the container. These rip-strips, as seen in FIGS. 1 and 2, may be integral with the wall of the container 10, which wall may be of plastic or cardboard or paperboard material having a wax or plastic coating or impregnation to render it waterproof. Each rip-strip, as 20, is separated or demarcated from the balance of the container wall by perforations 22. It is contemplated that there would be a vertical break also to determine the beginning and end of each rip-strip, and this could be picked out with the point of a knife, or possibly even a fingernail. However, in one preferred form of the invention I provide tabs 24 which are adhesively secured to one end of the rip-strip, and have an extending portion 26 readily grasped between the thumb and forefinger for tearing of the rip-strip from the wall of the container. As shown in FIG. 2 a film 28 of ice cream resistent material, such as a plastic strip, is secured to the inside wall of the container and the rip-strip, whereby to seal the perforation 22 against leakage of any of the ice cream 30 from a container when it is initially poured into the container in fluid condition, or subsequently if the ice cream should soften during shipment.

As is shown in FIG. 4, the film 28 may be more securely attached to the rip-strip 20 than to the inner surface of the container wall, whereby the plastic or the like film 28 will pull completely out of the container along with the rip-strip as the latter is removed. Thus, the overlying ring 32 of the container wall is completely separated from the remainder of the container upon tearing off of the rip-strip.

A modification of the invention is shown in FIG. 3 which is generally the same as that heretofore shown and described. However, two relatively thin strips 28*a* and 28*b* of plastic or other suitable ice cream impervious material are provided, each adhesively or otherwise suitably secured to the adjacent portion of the container wall, but not to the rip-strip 20, whereby the rip-strip can be torn from the container wall, readily separating from the films 28*a* and 28*b*, and thereby leaving the portions of the container completely separated from one another.

A further modification is shown in FIG. 5 wherein a wax coating 34 is applied more or less uniformly over the container wall in the vicinity of the rip-strip. When a pasteboard or other fibrous container, as distinguished from plastic containers, is used it is contemplated that this would be the waterproofing wax coating applied over the entire inner surface of the container. It will be understood that the term "wax" coating is used somewhat loosely, since many modern fiberboard containers have a waterproofing surface which is not technically wax, but which serves to the same end. No finger tab is shown in FIG. 5, and in this instance it is contemplated that the end of the rip-strip would be pulled out by the tip of a knife or by a fingernail, although it is contemplated that a finger tab could be applied here as in the previous embodiments.

Since the container is of cylindrical construction it is apparent that the cap or lid 12 will fit on to lower sections of the container after tearing out of rip-strips in exactly the same manner as it initially fits over the top of the container, as illustrated in FIG. 1. Although reference has been made throughout to ice cream, it will be understood that other liquid or fluid products, for example yogurt, could be stored in the container. The important feature is that the rip-strip in each instance is completely removed from the container, so that it generally is not necessary to cut the container wall, which might lead to contamination with a knife or other cutting implement. Furthermore, the perforations by which the rip-strip or rip-strips are formed are sealed, preferably from the inside, so as to prevent leakage when fluid ice cream is first poured into the container, or as the ice cream may soften in transit, and also to prevent penetration of bacteria into the package.

The specific examples of the invention as herein shown and described are for illustrative purposes. The container has been illustrated as a right circular cylinder, but it is apparent that any other suitable cross-section, for example square, could be used. Various other changes in structure will no doubt occur to those skilled in the art, and will be understood as forming a part of the present invention insofar as they fall within the spirit and scope of the appended claims.

The invention is hereby claimed as follows:

1. A container for ice cream or the like comprising a right cylindrical sidewall and having an open end, a lid interfitting with said open end, said sidewall having one or more peripheral rip-strips for separating an empty portion of said container from the balance of said container, each said rip-strip lying in a plane at right angles to the axis of said container and each having a peripheral discontinuity, said balance of said container then having a new open end with which said lid interfits, and readily destructable means for sealing each said rip-strip to the balance of the siewall comprising moisture impervious material overlying the juncture of said rip-strip and said sidewall on the inner surface of said sidewall and being fixed to said rip-strip, said material extending axially of said container a distance greater than said rip-strip spanning said rip-strip and the resulting cut edges of said sidewall container.

2. A container as set forth in claim 1 wherein said material comprises a strip secured to said rip-strip and pulled from said container therewith.

* * * * *